US005733201A

United States Patent [19]

Caldwell et al.

[11] Patent Number: 5,733,201

[45] Date of Patent: Mar. 31, 1998

[54] GOLF TRAINING GLOVE

[76] Inventors: Theodore W. Caldwell, 455 Brooks St., Laguna Beach, Calif. 92651; Ning Chen, 5670 Southview Dr., Yorba Linda, Calif. 92687

[21] Appl. No.: 661,041

[22] Filed: Jun. 10, 1996

[51] Int. Cl.[6] ..... A63B 69/36

[52] U.S. Cl. ..... 473/202; 473/205; 2/161.2

[58] Field of Search ..... 473/409, 205, 473/202, 204; 128/774; 2/161.1, 161.2, 161.3, 161.4

[56] References Cited

U.S. PATENT DOCUMENTS 3,670,574 6/1972 Edwards ..... 473/205 X 4,488,726 12/1984 Murray ..... 473/205 X 5,221,088 6/1993 McTeigue ..... 473/209 X 5,471,405 11/1995 Marsh ..... 128/774 X

*Primary Examiner*—George J. Marlo

*Attorney, Agent, or Firm*—G. Donald Weber, Jr.

[57] ABSTRACT

A golf glove which includes multi-function biofeedback instrumentation with extremely high degrees of precision that monitors a plurality of critical components of a golf swing. In particular, grip pressure is assessed by one or more sensors that discriminate finite changes in tension during the golf swing. Likewise, golf club head speed during the golf swing is monitored by an accelerometer which is attached to the glove. The detected parameters are displayed on a suitable display which is part of the instrumentation.

13 Claims, 1 Drawing Sheet

GOLF TRAINING GLOVE

BACKGROUND

1. Field of the Invention

This invention is directed to a golf training device, in general, and to such a training device in the form of a golf glove which incorporates devices for measuring various parameters of the golf swing, in particular.

2. Prior Art Statement

The game of golf is both old and new. It has a long and storied history. It is ongoing and ever changing in terms of the skill of players and the equipment used by the players.

The game is currently engaged in by millions of golfers in the U.S., Japan and other countries. Most golfers are avid enthusiasts of the game and are always seeking to improve their game by any legal and accepted method, including practice.

One of the items which is always sought by the golfing enthusiast is a training device which will improve his or her golf swing. There are special clubs, weights, video tapes and many other techniques for utilization during practice rounds or practice sessions. For example, there are "break-away" clubs, swing speed analyzers, swing trainers, mirrors, cameras, elastic bands, club attachments as well as many other similar devices. For the most part, these products are used in practice so that the golfer receives "feedback" on his or her swing. In this manner the golfer tends to "learn" the correct techniques.

Most of the equipment which is currently available for training purposes is mechanical in nature and is directed to various concepts such as positioning of the hands, retaining the position of the arms and so forth.

However, one of the more subtle difficulties encountered by most golfers is the manner in which the club is gripped during the swing. That is, the average golfer tends to grip the golf club entirely too tightly, thereby exerting excessive pressure on the club, the hands and thus, the arm muscles as well as other muscles which are involved in the swing.

It is well recognized that a significant improvement in an individual's ability to play the game can be obtained by avoiding the so-called "white knuckle grip" which is especially common for the average or recreational golfer. Unfortunately, neither the problem nor the solution is well recognized by the same golfer. Moreover, during the actual swing, it is difficult, if not impossible, for the average golfer to recognize that the grip has become tight or tense.

One method of overcoming this difficulty it to teach the golfer that the grip is too tight by means of a training device. By practicing with a relaxed grip, the physical aspects of the swing can be "memorized" or "internalized" so as to become second nature to the golfer. In order to do this, it is necessary to recognize when an appropriate swing has been achieved and to repeat this swing grip over and over to instill and implant the internal memorization of this grip.

Unfortunately, the practice and training devices currently available are not capable of performing this function wherein a new training device is highly desirable.

SUMMARY OF THE INSTANT INVENTION

The instant invention is directed to a training device in the form of a golf glove which is worn by the golfer in the same fashion as a conventional golf glove. The glove includes a plurality of sensors built into the inner portion thereof, for example on the palm and/or fingers of the glove. These sensors are calibrated to provide output signals which are indicative of the pressure applied to the golf club grip by the golfer's hands. A microprocessor circuit is connected to the sensors by appropriate devices including, for example, an A/D converter.

The signals are supplied to a suitable microcontroller or microprocessor which operates on the signal from the sensors to produce an output signal which can be in the form of a visual or an audio signal.

A suitable control panel or key pad can be used to adjust the operation of the microcontroller which is, typically, battery powered.

It is also contemplated that an accelerometer can be attached to the microcontroller through the A/D converter or the like wherein the speed of the club can be detected. The speed of the club can also be displayed on one or more of the displays.

DESCRIPTION OF A PREFERRED EMBODIMENT

Figure 1:
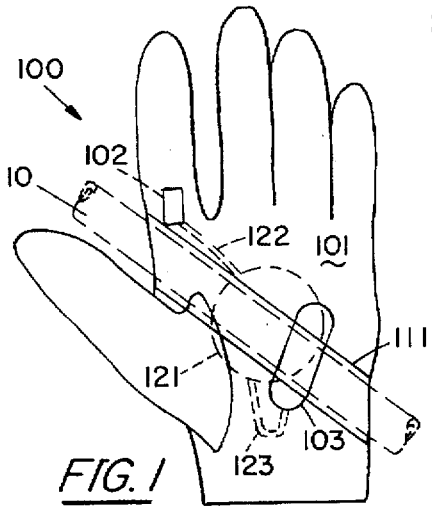
FIG. 1 is a schematic representation of the front or palm surface of the glove with a pair of sensors mounted thereon in one embodiment of the instant invention.

FIG. 1 is a schematic representation of one embodiment of the instant invention. In particular, the palm side 101 of a golf glove 100 is shown in accordance with the instant invention. In this case, the golf glove 100 is depicted as a left hand glove (used by right handed golfers). A counterpart right hand glove can be provided for left handed golfers.

The golf glove 100 includes the standard fingers, thumb, and wrist portion of a golf glove. In addition, a plurality of pressure sensor bladders, viz. bladders 102 and 103, are shown on the inner or palm surface 101 of the glove 100. In this embodiment, the pressure sensor bladder 102 is located at the surface 101 of the golf glove 100 in a position between the upper edge of the palm and the first knuckle of the index finger. In addition, pressure sensor bladder 103 is placed on surface 101 at approximately the heel of the palm. These bladders are affixed to the golf glove 100 in any suitable fashion, such as, but not limited to, by an adhesive, by sewing or the like. The bladders can be placed on the inner or outer surfaces of the glove 100 or intermediate the inner and outer layers of a glove. The bladders are used to detect the grip of the golfer on the golf club shaft 110 which is shown in dashed outline.

Individual catheters or tubes 122 and 123 are formed on the glove. These catheters communicate with the respective bladders 102 and 103 and suitable pressure sensors included within the instrumentation housing 121. The housing 121 may, preferably, take the form of a watch casement or the like.

For convenience, a suitable marking 111, for example an imprint, a stripe, stitching or the like is provided diagonally across the palm of the glove. The marking 111 is used to assist the golfer in positioning the golf club grip in the glove during use of the glove. Thus, the proper positioning of the glove and golf club grip and, thus, the functioning of the system can be enhanced.

It is, of course, possible that the placement of the sensor bladders can be modified slightly. In addition, the number of sensors can be increased or decreased depending upon the complexity of the monitoring systems and the accuracy of the monitoring which is desired. In a preferred embodiment, the pressure sensors can be pneumatic or hydraulic units or bladders, as desired. These sensors can be about ½" in diameter and about 6 mm. thick in one embodiment.

In operation, the bladders 102 and 103, as well as the catheters or tubes 122 and 123, are filled with air, gas or liquid, as desired. Any pressure exerted in the bladders by gripping the golf club 10 is transmitted to the sensors in the housing 121 via the tubes. The sensors thereby produce signals representative of the pressure exerted on the bladders and tubing.

Figure 2:
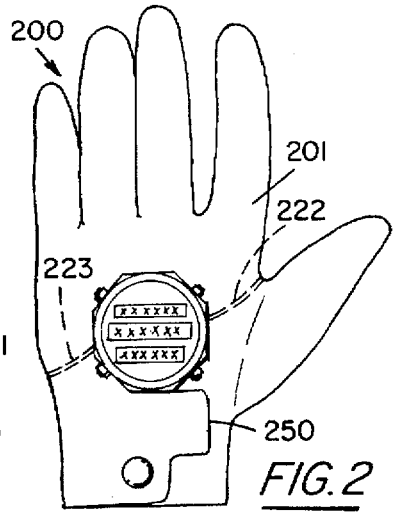
FIG. 2 is a schematic representation of the back of the glove with an instrumentation package mounted thereon in another embodiment of the instant invention.

FIG. 2 is a schematic representation of an embodiment of the invention wherein the housing 221 is mounted on the back 201 of the golf glove 200. In this embodiment, an instrumentation package circuit 221 is mounted on the back of the glove below the lower knuckles of the wearer's hand but above the conventional flap which is found in most golf gloves to secure the glove to the golfer's hand. Of course, the housing 221 may be mounted on the flap, if so desired. The instrumentation package 221 may be affixed to the glove 100 by any suitable means such as an adhesive, by stitching or the like. A hook and loop fastener (e.g. Velcro) can also be used to permit the package 221 to be removed from the glove 100, if so desired. The housing 221 is connected via tubing 222 and 223 to sensor bladders on the front of the glove in the same fashion as bladders 102 and 103 in FIG. 1. The packages 121 and 221 can be mounted on any portion of the glove or can be included in the securing flap 250 as noted above.

As described infra, the instrumentation package 221 can include a microprocessor circuit which is connected to receive "pressure" signals produced by the bladders 102 and 103. By analyzing the "pressure" signals, the circuit can assess if the pressure applied to the golf club is proper. Suitable output devices are included in the instrumentation package along with microprocessor circuitry 221 and can be combined as a single unit and be placed at any convenient location on the back of the glove.

An accelerometer can be separately mounted on glove 100 or can be included in the instrumentation package 221. Thus, the microprocessor in package 221 can read the grip pressure and the accelerometer can calculate the club head speed. From data registered in the instrumentation package 221 mounted on the glove 100, the club head speed can be calculated within a slight margin of error. The data produced by the circuit is read out on a display which can approximate a digital wrist-watch face in appearance, such as is shown in FIG. 3.

Figure 3:
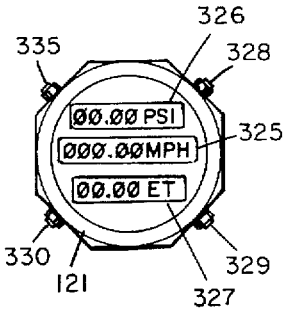
FIG. 3 is a schematic representation of one design of a monitoring unit of the instant invention.

FIG. 3 is an enlarged showing of the face of the instrumentation package 121 or 221. In this case, the instrumentation package includes several displays which are driven by signals detected by the circuitry shown in FIG. 4 and described in detail hereinafter.

For example, in FIG. 3, the instrumentation package includes a display 325 which provides a reading of the club head speed that was achieved at approximately the precise moment of contact with the ball. This display can be an LED-type display (or any suitable technology) and indicates the speed in miles-per-hour, for example. This reading is obtained from the accelerometer portion of the instrumentation package.

Display 326 is similar to display 325 in construction. However, display 326 is connected to the conventional pressure sensors which are connected to the bladders 102 and 103. Display 326 indicates the pressure on the bladders in PSI.

Display 327 is similar to display 325 and/or 326. However, display 327 indicates the elapsed time, in tenths of a second, of the golf swing. As will be noted, this parameter is related to the pressure detected during the golf swing as well as the speed of the golf club during the golf swing.

In addition, the instrumentation package 121 (or 221) includes several reset buttons or switches. In particular, reset button 328 is provided to selectively reset display 325 (and any related drive circuitry) to zero.

In like fashion, reset buttons 329 and 330 reset the elapsed time and grip pressure displays 326 and 327, respectively, to zero.

A master reset switch 335 can be used to set all functions and displays to zero concurrently.

Figure 4:
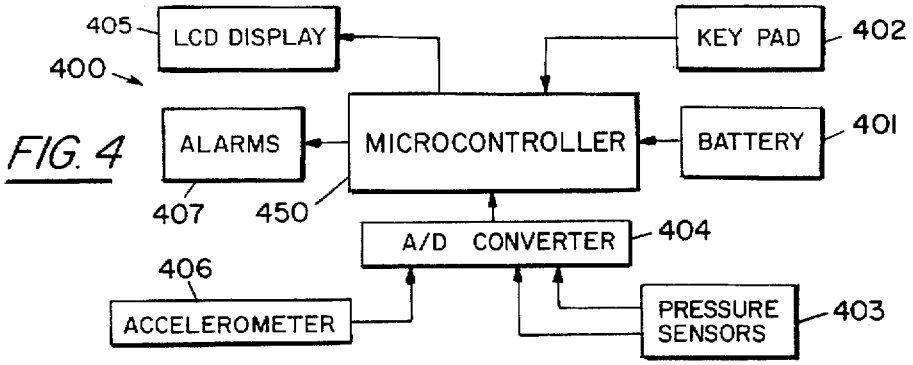
FIG. 4 is a block diagram of one embodiment of the monitoring circuit of the instant invention.

Referring now to FIG. 4, there is shown a block diagram of the swing monitor system 400 of the instant invention. This system is disposed within a suitable housing to form the instrumentation package 121 or 221 described supra.

In this embodiment, the microcontroller 450 is the basic operational and computational component of the system. The microcontroller 450 can be any type of microprocessor, such as a low power CMOS chip of any conventional design.

Battery 401 is any conventional battery which can be connected to microcontroller 450 to supply the appropriate power thereto. The battery is, typically, a small 3-volt, low power battery, for example the type used in digital wrist watches or the like.

A key pad 402 is connected to the controller 401 in order to apply selective control signals such as limit adjustments, sensitivity adjustments and the like to the operation of the circuitry. The keypad 402 can also include the reset buttons described supra. The keypad 402 can be included in the housing for the package 121 or 221 noted above.

The pressure sensors 403 are representative of suitable pressure sensors connected to bladders 102 and 103 shown in FIG. 1. Pressure sensors of this type are conventional in the art. A plurality of outputs from the pressure sensors 403 are shown to indicate the possibility of multiple bladders and sensors being used in the system.

In one embodiment, the pressure sensors are connected, via tubes 122 and 123, for example, to the pneumatic (or hydraulic) bladders 102 and 103 which measure pressures in the range of 0 to 30 psi and produce analog electrical signals representative of the pressure applied thereto. One example of the strategic location of the bladders is shown in FIG. 1.

The pressure sensors are connected to an A/D converter 404 of conventional design. A typical A/D converter device has an 8-bit resolution and converts the analog signal from the pressure sensors to a digital signal which is then supplied to the microcontroller 450.

A suitable display 405, for example a liquid crystal display (LCD), is connected to receive output signals from the microcontroller 450. Display 405 represents one (or more) of the displays 326, 327 and 328 shown in FIG. 3. The LCD display 405 is of typical design but may be custom made in order to provide any desirable display information such as that shown and described relative to FIG. 3. Of course, the display 405 can be an LED display or any other type of display which is of suitable size and within suitable power parameters.

As noted, an accelerometer 406 can be mounted to the back of the glove along with the other devices. The accelerometer 406 can be included in a unitary package along with all of the other materials and components of the system. Typically, the accelerometer is of conventional design and is aligned with the direction of the swing. The accelerometer measures the force of the swing usually within an acceleration rate of 0 to +/−5g's.

The accelerometer 406 also produces an analog electrical signal which is supplied to A/D converter 404 for conversion into a digital signal. This digital signal is presented to the microcontroller 450. The signal generated by the accelerometer then is converted to a reasonably accurate approximation of the club head speed which is provided at display 405.

The microcontroller 450, in addition to supplying the signals to the display 405, also can supply signals to alarms 407 mounted in the instrumentation package 221. The alarms can be either audible or visual (or both). The audible alarm can take the form of a buzzer which alerts the golfer to an improper swing in terms of excessive pressure on the grip (as detected by the pressure sensors).

Conversely, the visual alarm 407 can be in the form of an LED or other similar light display which can be used when an audible sound is not desired.

Figure 5:
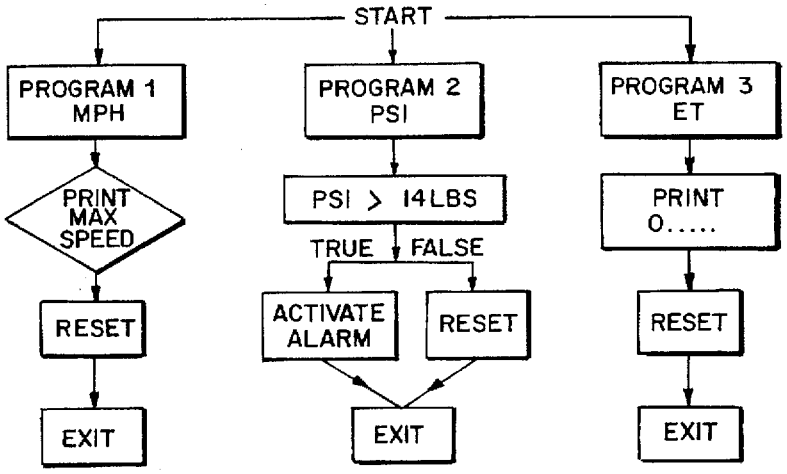
FIG. 5 is a flow chart of the operation of the system shown in FIG. 4.

FIG. 5 is a schematic representation of a flow chart for the operation of the circuit. In one emobidment, this flow chart is representative of the "fuzzy" logic operation of the microprocessor 450. Typically, the flow chart shows three (3) subroutines processed by microcomputer 450. For example, Program #1 is related to the operation of the accelerometer 406. This program supplies the value of the club speed head in M.P.H. to display 325. This program is reset by switch 328.

Program #2 measures the elapsed time of the golf club swing and drives the display 327. This program is reset by switch 329.

Program #3 is related to the pressure sensors 403 and supplies a readout in PSI. In addition, Program #3 selectively activates alarms 407 when at least one of the pressure sensors detects a grip pressure above a preset level, e.g. 14 PSI. This program is reset by switch 330.

Figure 6:
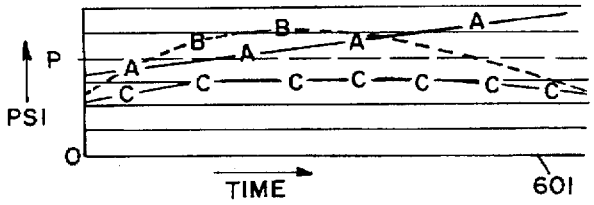
FIG. 6 is a graphical representation of the timing of the golf swing relative to the instant invention.

Referring now to FIG. 6, there is shown a graphic representation of the swinging of the golf club by the golfer. The time line 601 begins at the start of the swing of the golf club, i.e. addressing the ball. The end of the swing time line 601 is the moment the club head strikes the golf ball. Intermediate the beginning and ending of the time line, the device provides an indication of the grip pressure which is measured. The indication shows when, if at all, the grip pressure exceeds the threshold pressure Pt, typically about 14 PSI. In this display, the variation in grip pressure is shown. For example, line A shows that the less accomplished golfer tends to grip the golf club too tightly—and to increase the gripping pressure throughout the swing. The more adept golfer, as shown by line B, tends to start and finish the swing with reasonable grip pressure but, during the swing "squeezes" the club and looses control of the golf swing. On the other hand, line C shows the grip pressure of the accomplished and/or professional golfer, for example. In this case, the grip pressure never exceeds the threshold pressure Pt.

In accordance with this invention, the application of excessive pressure is indicated by sounding an alarm 407 noted above. Through the use of this training device, the golfer can learn to avoid or eliminate any excessive pressure from the swing. By using this golf glove as a training device, the golfer can ultimately "memorize" the type of golf swing which is desired to optimize the playing of the game.

Thus, there is shown and described a unique design and concept of a golf training glove. While this description is directed to a particular embodiment, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

We claim:

1. A golf training device comprising, a golf glove, accelerometer means mounted on said glove, at least one pressure sensor on the front of said glove, each said sensor is a pneumatic sensor, an electronic monitoring circuit, said electronic monitoring circuit connected to each said pressure sensor and to said accelerometer means, said electronic monitoring circuit operative to measure the parameters of the pressure exerted on each said pressure sensor on said glove, the speed of said glove, and the elapsed time of movement of said glove during a golf swing, display means connected to said electronic monitoring circuit to display the several parameters defined by movement of said glove during a golf swing, and housing means mounted on the back of said glove to encase said electronic monitoring circuit and said display means.

2. The device recited in claim 1 including, tubes mounted to said glove to interconnect each said pressure sensor to said electronic monitoring circuit.

3. The device recited in claim 1 including, converter means connected intermediate each said pressure sensor and said electronic monitoring circuit.

4. The device recited in claim 3 wherein, said converter means comprises an analog to digital signal converter.

5. The device recited in claim 1 wherein, said electronic monitoring circuit includes microprocessor means.

6. The device recited in claim 1 wherein, said display means comprises a liquid crystal display device.

7. The device recited in claim 1 including, alarm means connected to said electronic monitoring circuit.

8. The device recited in claim 7 wherein, said alarm means selectively provides an audible alarm signal.

9. The device recited in claim 7 wherein, said alarm means selectively provides a visual alarm signal.

10. The device recited in claim 1 including, switch means for selectively controlling the operation of said electronic monitoring circuit.

11. The device recited in claim 10 wherein, said switch means includes reset switches connected to said electronic monitoring circuit and to said display means.

12. The device recited in claim 1 including, position marking means on the front of said glove to assist in the positioning of a golf club relative to said glove during said golf swing.

13. A self contained golf training device including, a glove, accelerometer means mounted on said glove, pressure sensitive means mounted on the palm surface of said glove, and monitoring circuit means mounted on the back surface of said glove, said monitoring circuit means connected to said pressure sensitive means to measure the pressure exerted on a golf club by the wearer of said glove during a golf swing and to said accelerometer means to measure the speed of said golf club during said golf swing.

* * * * *